US007978170B2

(12) United States Patent
Park et al.

(10) Patent No.: US 7,978,170 B2
(45) Date of Patent: Jul. 12, 2011

(54) DRIVING APPARATUS OF BACKLIGHT AND METHOD OF DRIVING BACKLIGHT USING THE SAME

(75) Inventors: Sin Kyun Park, Gyeonggi-do (KR); Jeong Whan Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 769 days.

(21) Appl. No.: 11/634,304

(22) Filed: Dec. 6, 2006

(65) Prior Publication Data

US 2007/0132711 A1 Jun. 14, 2007

(30) Foreign Application Priority Data

Dec. 8, 2005 (KR) ..... 10-2005-0119970

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 6,429,839 | B1 * | 8/2002 | Sakamoto | 345/87 |
| 2003/0038770 | A1 * | 2/2003 | Lee et al. | 345/102 |
| 2005/0190142 | A1 * | 9/2005 | Ferguson | 345/102 |
| 2007/0236445 | A1 * | 10/2007 | Gong et al. | 345/102 |
| 2008/0191634 | A1 * | 8/2008 | Jeong | 315/209 R |

FOREIGN PATENT DOCUMENTS

WO WO 2004/082339 * 9/2004

* cited by examiner

*Primary Examiner* — Richard Hjerpe
*Assistant Examiner* — Andrew Schnirel
(74) *Attorney, Agent, or Firm* — Morgan, Lewis & Bockius LLP

(57) ABSTRACT

A driving apparatus of a backlight includes a controller for controlling square wave oscillation, a square wave oscillator for oscillating a constant square wave signal in accordance with a control signal from the controller, and a signal generator for generating a burst dimming signal using the square wave signal.

12 Claims, 9 Drawing Sheets

DRIVING APPARATUS OF BACKLIGHT AND METHOD OF DRIVING BACKLIGHT USING THE SAME

This application claims the benefit of Korean Patent Application No. P05-0119970 filed in Korea on Dec. 8, 2005, which is hereby incorporated by reference in its entirety.

BACKGROUND OF THE INVENTION

1. Field of the Invention

This invention relates to a backlight of a display device, and more particularly to a driving apparatus of a backlight and a method of driving a backlight using the same. Although the present invention is suitable for a wide scope of applications, it is particularly suitable for generating a burst dimming signal having a consistent On/Off duty cycle.

2. Description of the Related Art

In general, a liquid crystal display (LCD) device displays images by controlling optical transmittance of liquid crystal cells. An active matrix type of liquid crystal display device having a switching device provided for each liquid crystal cell is advantageous in the implementation of moving pictures because of the speed at which the switching devices can be switched. The switching devices used for the active matrix liquid crystal display devices are typically thin film transistors (TFT).

FIG. 1 is an equivalent circuit diagram of a pixel provided in the related art liquid crystal display device. The active matrix type liquid crystal display device converts a digital input data into an analog data voltage on the basis of a gamma reference voltage and then supplies the analog data voltage to a data line DL while also supplying a scanning pulse to a gate line GL to charge a liquid crystal cell Clc with the analog data voltage from the data line DL. A gate electrode of the TFT is connected to the gate line GL while a source electrode is connected to the data line DL. Further, a drain electrode of the TFT is connected to a pixel electrode of the liquid crystal cell Clc and to one electrode of a storage capacitor Cst. A common electrode of the liquid crystal cell Clc is supplied with a common voltage Vcom.

When the scanning pulse is applied to the gate line GL, then the TFT is turned on to provide a channel between the source electrode and the drain electrode, so that a voltage on the data line DL is supplied to the pixel electrode of the liquid crystal cell Clc. The storage capacitor Cst receives the analog data voltage from the data line DL when the TFT is turned on and maintains the charged analog data voltage in the liquid crystal cell Clc. The alignment state of the liquid crystal molecules is changed by an electric field between the pixel electrode and the common electrode. As a result, the optical transmittance of the liquid crystal is changed according to the changed alignment of the liquid crystal.

FIG. 2 is a block diagram showing a typical configuration of the related art liquid crystal display device. Referring to FIG. 2, the related art liquid crystal display device 100 includes a liquid crystal display panel 110 provided with a thin film transistor (TFT) for driving the liquid crystal cells Clc at each crossing of the data lines DL1 to DLm and the gate lines GL1 to GLn, a data driver 120 for supplying data to the data lines DL1 to DLm of the liquid crystal display panel 110, a gate driver 130 for supplying a scanning pulse to the gate lines GL1 to GLn of the liquid crystal display panel 110, an external power source 140 connected to the data driver 120, a timing controller 150 for controlling the data driver 120 and the gate driver 130, a backlight assembly 160 for irradiating a light to the liquid crystal display panel 110 and an inverter 170 for applying an alternating current voltage to the backlight assembly 160.

The liquid crystal display panel 110 has a liquid crystal injected between upper and lower glass substrates (not shown). On the lower glass substrate of the liquid crystal display panel 110, the data lines DL1 to DLm and the gate lines GL1 to GLn perpendicularly cross each other. At each crossing of the data lines DL1 to DLm and the gate lines GL1 to GLn, TFTs are provided. The TFTs switch data from the data lines DL1 to DLm to the liquid crystal cells Clc in response to scanning pulses. The gate electrodes of the TFTs are connected to the gate lines GL1 to GLn while the source electrodes thereof are connected to the data lines DL1 to DLm. Further, the drain electrodes of the TFTs are connected to the pixel electrodes of the liquid crystal cells Clc and to the storage capacitors Cst.

The TFT is turned on in response to the scanning pulse applied, via the gate lines GL1 to GLn, to the gate terminal thereof. Upon turning-on of the TFT, a video data on the data lines DL1 to DLm is supplied to the pixel electrode of the liquid crystal cell Clc. The timing controller 150 supplies a digital video data RGB to the data driver 120. Also, the timing controller 150 generates a data driving control signal DDC and a gate driving control signal GDC using a horizontal/vertical synchronizing signal H and V, and a clock signal CLK. The data driving control signal DDC includes a source shift clock SSC, a source start pulse SSP, a polar control signal POL and a source output enable signal SOE. The data driving control signal DDC is supplied to the data driver 120. The gate driving control signal GDC includes a gate start pulse GSP, a gate shirt clock GSC and a gate output enable GOE. The gate driving control signal GDC is supplied to the gate driver 130.

The gate driver 130 sequentially generates a scanning pulse, such as a gate high pulse, in response to the gate driving control signal GDC supplied from the timing controller 150. The gate driver 130 includes a shift register (not shown) for sequentially generating the scanning pulse and a level shifter (not shown) for shifting the swing width of the scanning pulse voltage to voltages higher than the threshold voltage of the TFTs.

The data driver 120 supplies a data to the data lines DL1 to DLm in response to the data driving control signal DDC from the timing controller 150. Further, the data driver 120 samples and latches digital video data RGB fed from the timing controller 150. Then, the data driver converts the latched digital video data RGB into an analog voltage capable of expressing a gray scale level in the liquid crystal cell Clc.

The backlight assembly 160 provided at the rear side of the liquid crystal display panel 110 radiates light to each pixel of the liquid crystal display panel 110 in response to an alternating current (AC) voltage supplied from the inverter 170. The inverter 170 converts a square wave signal generated within the inverter into a triangular wave signal and then compares the triangular wave signal with a direct current (DC) voltage supplied from an exterior electronic device, such as a controller of the image display apparatus, thereby generating a burst dimming signal proportional to a result of the comparison. Herein, if the exterior electronic device is a controller for controlling a function of the image display apparatus, then the exterior electronic device supplies the DC voltage having a value approximately 0V to 3.3V to the inverter 170. If the burst dimming signal determined in accordance with the rectangular wave signal at the interior of the inverter 170, then a driving integrated circuit IC (not shown) for controlling a generation of the AC voltage within the inverter 160 controls a generation of the AC voltage supplied to the backlight assembly 160 in response to the burst dimming signal.

When the resistance of an interior resistance element changes due to an increase in temperature within the inverter 170 of the related art driving apparatus, then the On/Off duty cycle of the square signal oscillated within the interior of the inverter 170 is also changed. Accordingly, the On/Off duty cycle of a burst dimming signal used for controlling a magnitude of the AC voltage supplied to the backlight assembly 160 is also changed. The burst dimming signal is affected by the square signal being changed by an increase in temperature within the inverter. Such changes in the burst dimming signal can cause the problem of wavy noise to be generated on the liquid crystal display panel. Also, the inverter 170 having the related art driving apparatus is not controlled by the image display apparatus. Accordingly, if an irradiating system of the image display apparatus, for example, a PAL system or an NTSC system, is changed, the inverter 170 may not oscillate the correct square wave signal for the irradiating system.

SUMMARY OF THE INVENTION

Accordingly, the present invention is directed to a driving apparatus of a backlight and a method of driving a backlight using the same that substantially obviate one or more of the problems due to limitations and disadvantages of the related art.

An object of the present invention to provide a driving apparatus of a backlight and a method of driving a backlight using the same that maintains burst dimming signal with a consistent On/Off Duty cycle.

Another object of the present invention is to provide a driving apparatus of a backlight and a method of driving a backlight using the same for supplying a constant alternating current voltage to a backlight assembly that is not affected by exterior environmental temperatures.

Another object of the present invention is to provide a driving apparatus of a backlight and a method of driving a backlight using the same for preventing generation of wavy noise on a liquid crystal display panel.

Another object of the present invention is to provide a driving apparatus of a backlight and a method of driving a backlight using the same that are adaptive to a change of scanning systems.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus of a backlight, includes a controller for controlling square wave oscillation, a square wave oscillator for oscillating a constant square wave signal in accordance with a control signal from the controller, and a signal generator for generating a burst dimming signal using the square wave signal.

In another aspect, a method of driving an backlight includes generating a square wave oscillation control signal for controlling a square wave oscillation, oscillating a constant square wave signal based upon with the square wave oscillation control signal, and generating a burst dimming signal having a consistent On/Off duty cycle in an inverter based upon the constant square wave signal.

In another aspect, an image display apparatus includes a controller for providing a control signal to control a square wave oscillation, a square wave oscillator for oscillating a constant square wave signal in accordance with the control signal of the controller, and an inverter for generating a burst dimming signal using the constant square wave signal from the square wave oscillator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Hereinafter, the preferred embodiments of the present invention will be described in detail with reference to the accompanying drawings.

Figure 1:
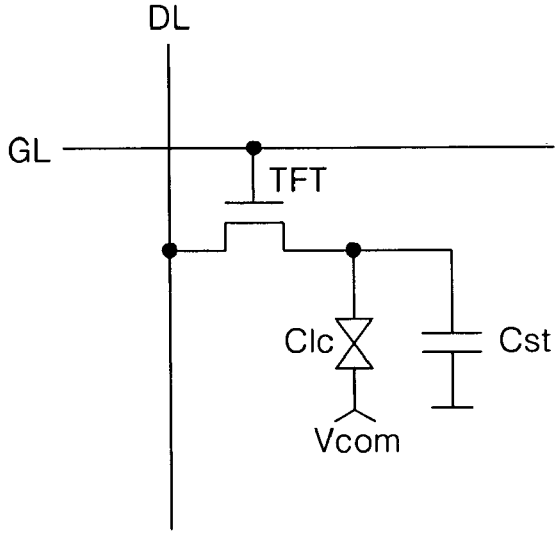
FIG. 1 RELATED ART
FIG. 1 is an equivalent circuit diagram of a pixel provided in the related art liquid crystal display device.
Figure 2:
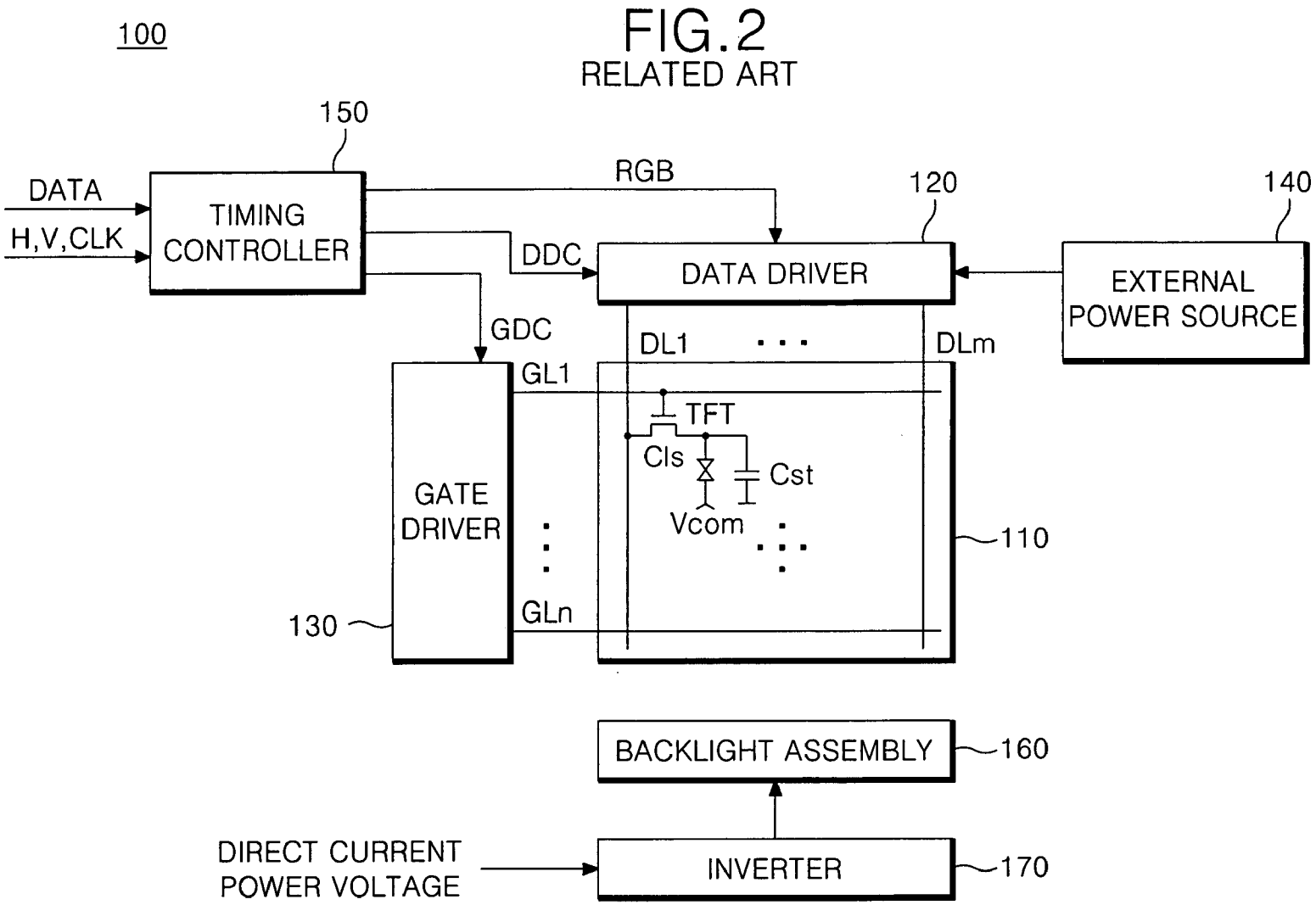
FIG.2 RELATED ART
FIG. 2 is a block diagram showing a configuration of the related art liquid crystal display device.
Figure 3:
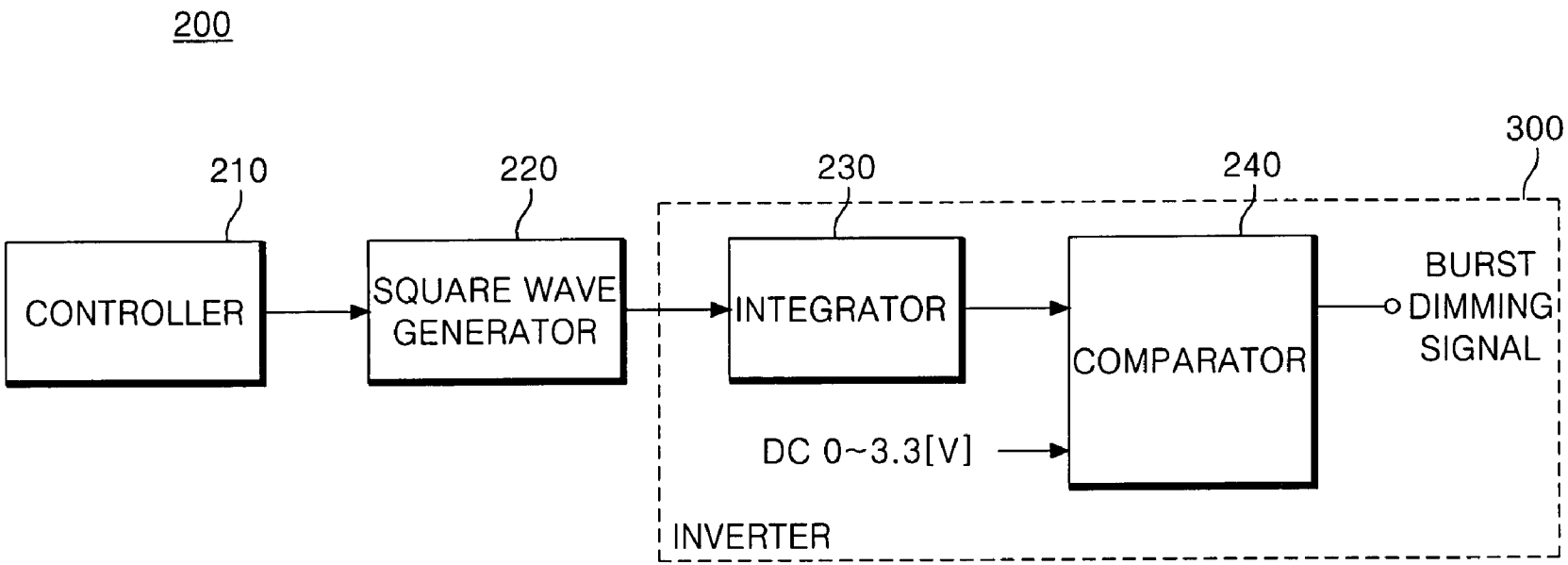
FIG. 3 is a block diagram showing an apparatus for driving backlight according to an embodiment of the present invention.

FIG. 3 is a block diagram showing an apparatus for driving a backlight according to an embodiment of the present invention. Referring to FIG. 3, a driving apparatus 200 for a backlight (refer to the reference number 422 of FIG. 7) according to an embodiment of the present invention includes a controller 210 for controlling wave generation, a square wave generator 220 for generating a constant square wave signal in accordance with a control signal of the controller 210, and an inverter 300. An integrator 230 within the inverter 300 converts a constant square wave from the square wave generator 220 into a triangular wave. A comparator 240 within the inverter 300 compares the triangular wave converted by the integrator 230 with a direct current voltage DC Voltage and then generates a burst dimming signal having a consistent On/Off duty cycle in accordance with the result.

A square wave generation execution program for controlling generation of a constant square wave signal is provided in the controller 210. The execution program is carried out in accordance with a user's command inputted through a television remote control (not shown). If the square wave generation execution program is carried out, then the controller 210 outputs an oscillation control signal for generating a constant square wave signal to the square wave generator 220.

Figure 4A:
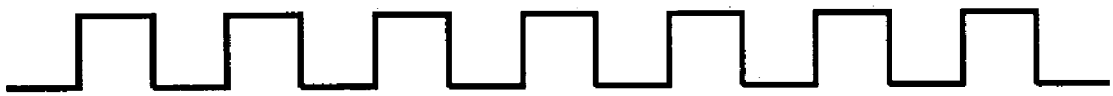
FIG. 4A is a waveform diagram showing a square wave from the square wave oscillator shown in FIG. 3.
Figure 7:
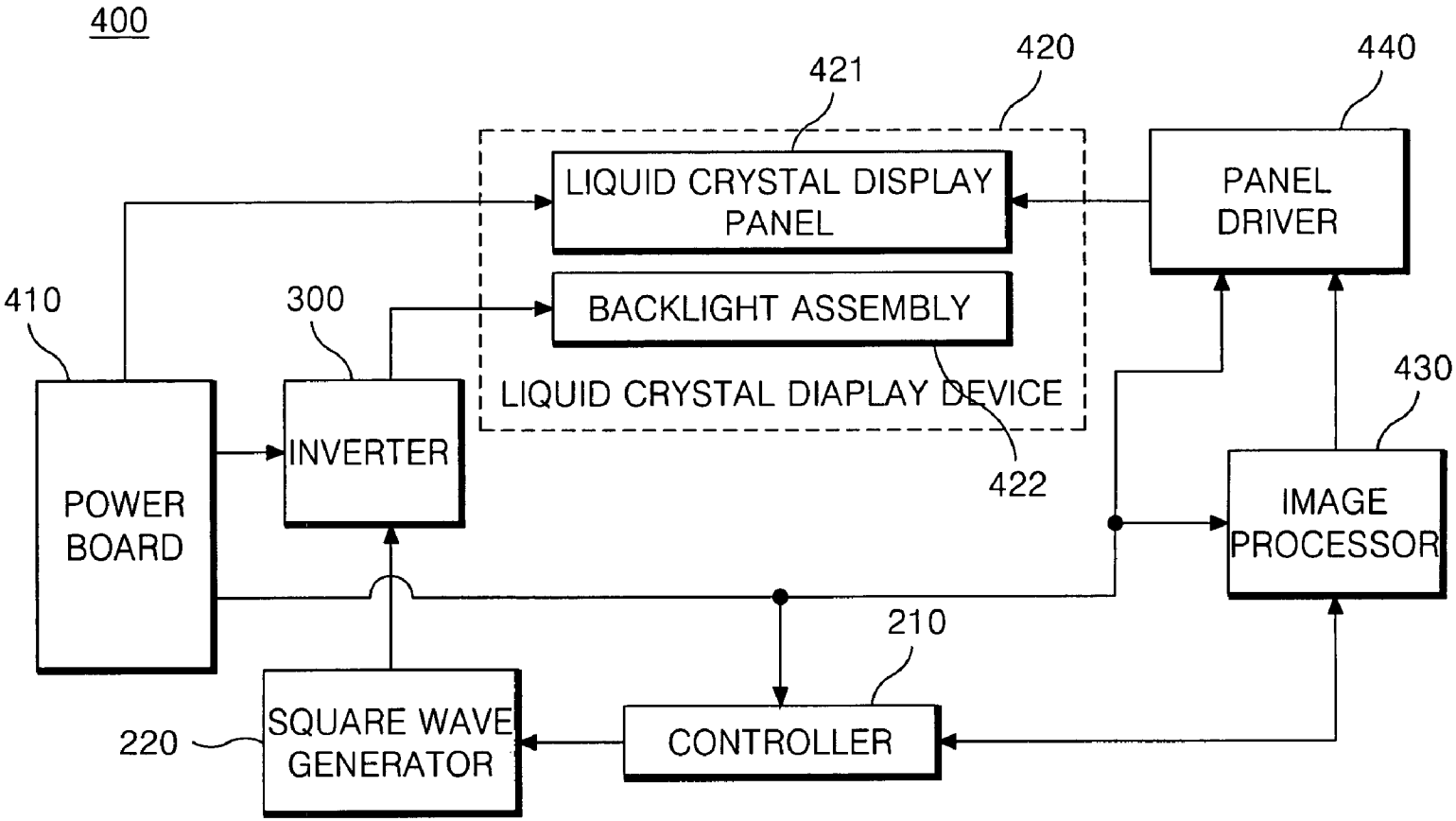
FIG. 7 is a block diagram showing the image display adopted a driving apparatus including inverter according to an embodiment of the present invention.

In an embodiment of the present invention, the square wave oscillation execution program is set in the controller 210 for controlling the image display function of the image display apparatus shown in FIG. 7, such as a TV set. The square wave oscillator 220 oscillates a square wave signal in accordance with a square wave oscillation control signal generated from the controller 210. In an embodiment of the present invention, the square wave oscillator 220 and the controller 210 are installed within the image display apparatus 400 (refer to FIG. 7) but separate from the inverter 300. Since the square wave oscillator 220 is installed outside of the inverter 300, the square wave oscillator 220 always oscillates a constant square wave signal and outputs it to the integrator 230 as shown in FIG. 4A, irregardless of the interior temperature of the inverter 300.

Figure 4B:
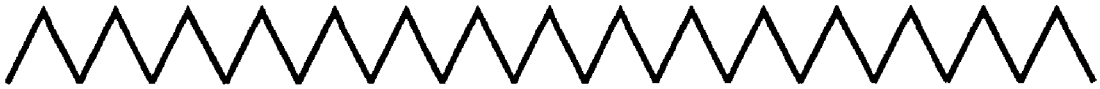
FIG. 4B is a waveform diagram showing a triangular wave outputted from the integrator shown in FIG. 3.
Figure 4C:
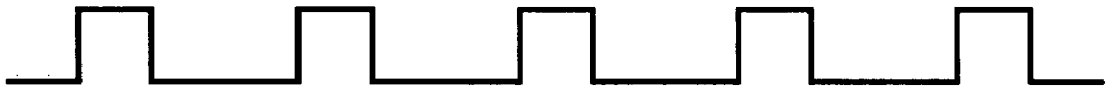
FIG. 4C is a waveform diagram showing a characteristics of a burst dimming signal outputted from the comparator shown in FIG. 3.

Referring to FIG. 4B, the integrator 230 converts a square wave signal from the square wave oscillator 220 into a triangular wave and outputs it to the comparator 240. The comparator 240 receives the triangular wave outputted from the integrator 230 through one input terminal while receiving a direct current voltage of about 0V to 3.3V through another input terminal, and outputs a burst dimming signal through an output terminal as shown in FIG. 4C. The direct current voltage of 0V to 3.3V can be received from the controller 210.

The burst dimming signal outputted from the comparator 240 is input to a driving IC (not shown because this is the same element as in the related art) for controlling generation of the alternating current voltage within the inverter 300. Since an embodiment of the present invention oscillates a constant square wave signal irregardless of the temperature within the inverter 300, the comparator 240 outputs a consistent burst dimming signal to the driving IC. Accordingly, the driving IC outputs an alternating current voltage in which the magnitude is constantly adjusted to provide a consistent burst dimming signal to the backlight assembly 422 (in FIG. 7). Thus, it becomes possible to prevent a generation of a wavy noise on a screen.

Figure 5:
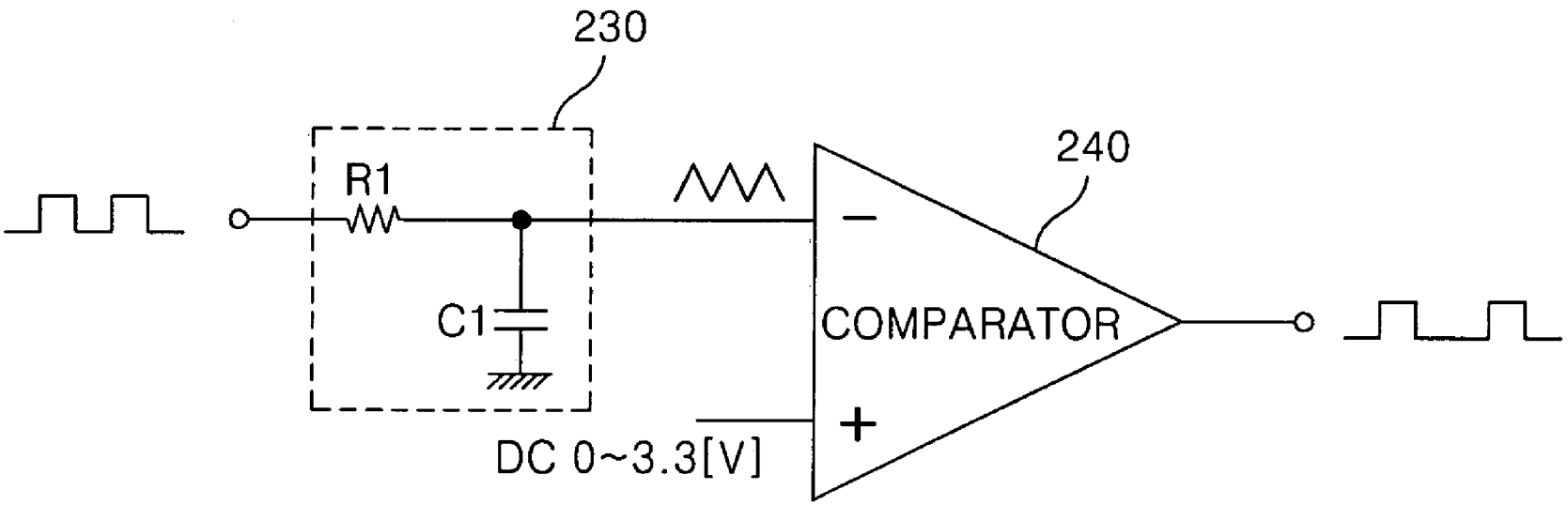
FIG. 5 is a circuit diagram showing the integrator and the comparator shown in FIG. 3.

A specific configuration of the circuit will be described with reference to FIG. 5, which is a circuit diagram showing the integrator and the comparator of FIG. 3. Referring to FIG. 5, the integrator 230 includes a resistance R1 connected between an output terminal of the square wave oscillator 220 and an input terminal of the comparator 240, and a capacitor C1 in which an electrode of the capacitor C1 is commonly connected to the input terminal of the input terminal of the comparator 240 and another electrode of the capacitor C1 is connected to the ground. The square wave signal from the square wave oscillator 220 is converted into the triangular wave signal and inputted to one input terminal of the comparator 240. The comparator 240 receives the triangular wave outputted from the integrator 230 through an inverting input terminal (−) while also receiving a direct current voltage of 0V to 3.3V through a non-inverting input terminal (+), and outputs a burst dimming signal via an output terminal. In this embodiment of the present invention, the controller 210 supplies the direct current voltage of 0V to 3.3V, but such a direct current voltage can be supplied from other sources.

The comparator 240 compares the direct current voltage inputted to the non-inverting input terminal (+) on the basis of the triangular wave signal inputted to the inverting input terminal (−) and outputs the burst dimming signal from the output terminal. For example, a first signal is outputted at an interval when the triangular wave signal is greater than the direct current voltage. Since the triangular wave signal is inputted with the inverting input terminal (−), an inverted signal of the high signal, that is, a low signal is outputted. Otherwise, a second signal is outputted at an interval when the triangular wave signal is smaller than the direct current voltage. Since the triangular wave signal is inputted with the inverting input terminal (−), the inverted signal of the low signal, that is, the high signal is outputted. As a result, the comparator 240 outputs the burst dimming signal as shown in FIG. 4C.

Figure 6:
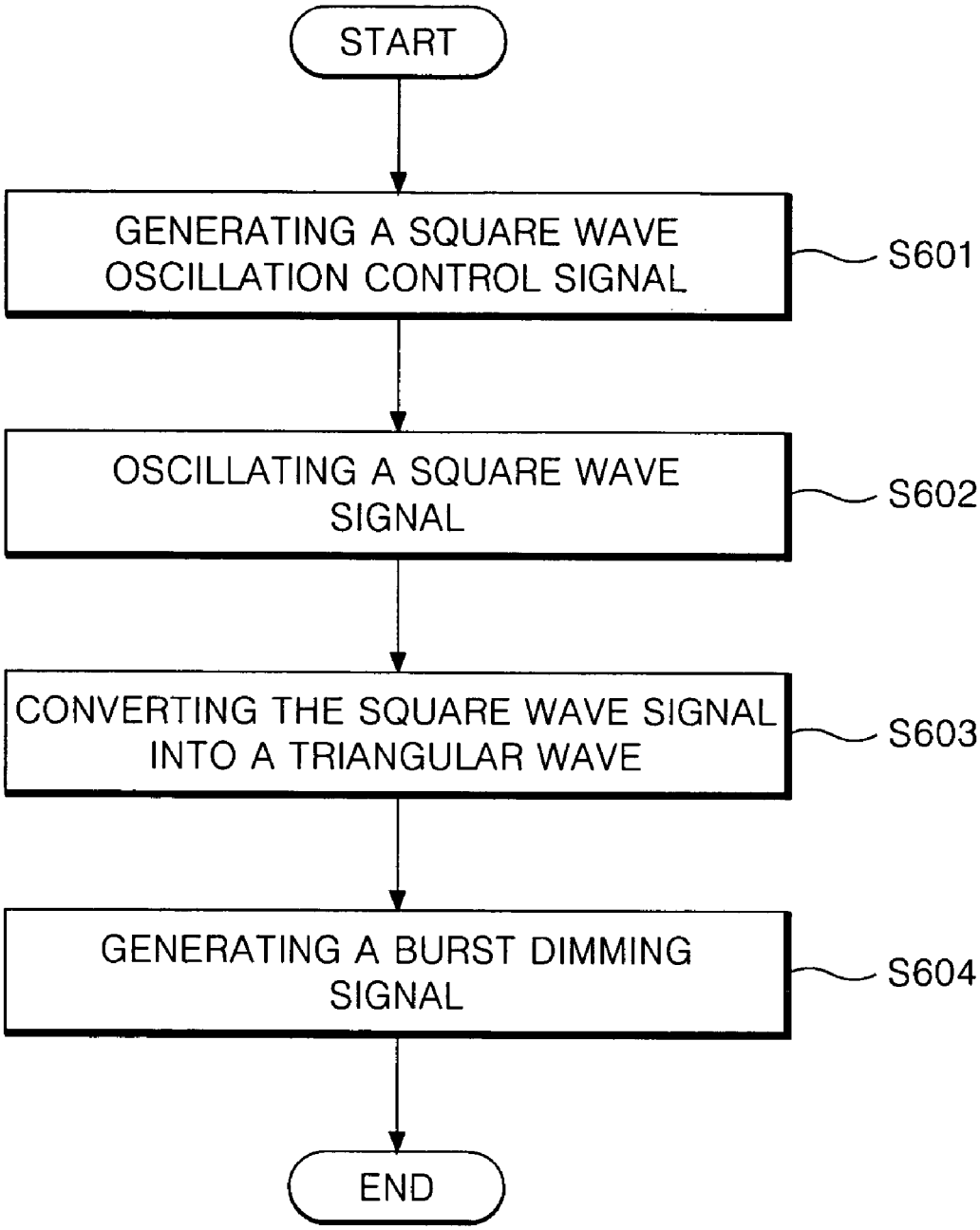
FIG. 6 is a flow chart showing a method of driving an inverter according to an embodiment of the present invention.

FIG. 6 is a flow chart showing a method of driving an inverter according to an embodiment of the present invention. Referring to FIG. 6, if a driving command of the image display apparatus is inputted by the user, then the controller 210 carries out a designated square wave oscillation execution program and generates a constant square wave oscillation control signal in accordance with the execution program and supplies the direct current voltage of 0V to 3.3V to the comparator 240 (S601). If the square wave oscillation control signal is generated, the square wave oscillator 220 provides a constant square wave signal in accordance with the square wave oscillation control signal generated from the controller 210 and outputs the constant square wave signal to the integrator 230, as shown in FIG. 4A (S602). If the square wave signal is generated, the integrator 230 converts the square wave signal into a triangular wave and outputs the triangular wave to the comparator 240, as shown in FIG. 4B (S603). Then, the comparator 240 compares the direct current voltage of 0V to 3.3V inputted from the non-inverting input terminal (+) with the triangular wave signal inputted from the inverting input terminal (−) and outputs the burst dimming signal to the output terminal, as shown in FIG. 4C (S604).

FIG. 7 is a block diagram showing the image display apparatus adopted an inverter according to an embodiment of the present invention. Referring to FIG. 7, the image display apparatus 400 includes a power board 410 for transforming an alternating current voltage 220V (AC 220V) inputted from an external power source into a direct current power source voltage; a liquid crystal display device 420 for displaying the image; a controller 210 for generating the square wave oscillation control signal to control a generation of a square wave signal, for supplying the direct current voltage of 0V to 3.3V, and for controlling a brightness of screen output on the liquid crystal display device 420 in accordance with a user's command and a variable of the image contrast; an image processor 430 for increasing and decreasing a gain of an image signal to be displayed on the liquid crystal display device 420 in accordance with a contrast control signal inputted from the controller 210; a panel driver 440 for displaying the image signal inputted from the image processor 430 at the liquid crystal display device 420; a square wave oscillator 220 for oscillating a constant square wave signal in accordance with a square wave oscillation control signal from the controller 210; and the inverter 300 for converting the direct current power source voltage from the power board 410 into the alternating current power source voltage in accordance with the square wave signal from the square wave oscillator 220 to supply the alternating current voltage to the liquid crystal display device 420.

The power board 410 transforms the alternating current voltage, such as 220 VAC, inputted from the external power source into direct current power source voltage, such as 24V, and supplies the direct current power source voltage to the liquid crystal display device 420, the controller 210, the image processor 430, the panel driver 440 and the inverter 300. In the alternative, the power board 410 may be implemented in such a manner so as to supply a different direct current voltage, such as 12V to the inverter 300 in accordance with a capacitance value of the liquid crystal display device 420.

The liquid crystal display device 420 includes a liquid crystal display panel 421 for displaying the image and a backlight assembly 422 for generating a light for the image displayed on the liquid crystal display panel 421. The LCD panel 421 is driven by the direct current power source applied from the power board 410 to display the image signal transmitted from the panel driver 440. The brightness of the screen is varied in accordance with the intensity of the light irradiated from the backlight assembly 422, and the contrast of the outputted image is varied in accordance with the gain of the image signal outputted from the image processor 430. If the intensity of the light irradiated from the backlight assembly 422 is increased, then the brightness is increased, while if the intensity of the light irradiated from the backlight assembly 422 is decreased, then the brightness is decreased. If the gain of the image signal outputted from the image processor 430 is increased, then the contrast is increased, while if the gain of the image signal outputted from the image processor 430 is decreased, then the contrast is decreased.

The backlight assembly 422 includes a plurality of lamps (not shown) arranged in a row at a rear side of the LCD panel 421. The a plurality of lamps are turned-on by the alternating current voltage current supplied from the inverter 300. The intensity of the irradiated light varies in proportion to the current amount received from the inverter 300. In other words, if the inputted current amount is increased, then the intensity of the light irradiated from the backlight assembly 422 is increased, while if the inputted current amount is decreased, then the intensity of the light irradiated from the backlight assembly 422 is decreased. As a result, the brightness of the LCD panel 421 is made brighter or dimmer by respectively increasing or decreasing the intensity of the light irradiated into the LCD panel 421.

The controller 210 controls the brightness of the screen and the contrast of the image in accordance with the user's command. If the user inputs a brightness increase command using a remote control (not shown), then the controller 210 outputs a brightness control signal indicating a brightness increase, such as a brightness increase signal, to the inverter 300. The inverter 300 increases the current amount supplied to the backlight assembly 422 in accordance with the brightness up signal to increase the intensity of the light from the backlight assembly 422. Thus, the brightness of the screen on the LCD panel 421 increases.

If the user inputs a brightness decrease command using a remote control (not shown), then the controller 210 outputs a brightness control signal indicating a brightness decrease, such as a brightness decrease signal, to the inverter 300. The current supplied to the backlight assembly 422 from the inverter 300 decreases in accordance with the brightness decrease signal to decrease the intensity of the light from the backlight assembly 422. Thus, the brightness of the screen on the LCD panel 421 decreases.

The embodiment of the present invention uses a square wave oscillation execution program in the controller 210 so that the controller 210 outputs the square wave oscillation control signal for controlling a constant square wave signal from the square wave oscillator 220. The square wave oscillator 220 provides a constant square wave signal in accordance with the square wave oscillation control signal generated from the controller 210 and outputs the square wave signal to the inverter 300. The inverter 300 uses the direct current voltage supplied from the power board 410 to generate a driving current of the backlight assembly 422, and increases or decreases the current amount supplied to the backlight assembly 422 in accordance with the brightness control signal inputted from the controller 210. If the controller 210 outputs the brightness decrease signal, then the inverter 300 decreases the current amount supplied to the backlight assembly 422 to decrease the brightness of the display. On the other hand, if the controller 210 outputs the brightness increases signal, then the inverter 300 increases the current amount supplied to the backlight assembly 422 to increase the brightness.

The inverter 300 includes a integrator 230 for converting the square wave signal from the square wave oscillator 220 into a triangular wave signal and a comparator 240 for comparing the triangular wave signal outputted from the integrator 230 with the direct current voltage of 0V to 3.3V to output the burst dimming signal. Since the inverter 300 is implemented in such a manner as to generate the burst dimming signal in accordance with a control of the controller 210 controlling the image display function of the image display apparatus 400, then the inverter 300 can generate burst dimming signals for different scanning systems. The inverter 300 can be appropriately controlled to accommodate changes from the PAL system to the NTSC system or from the NTSC system to the PAL system.

The image processor 430 adjusts a screen size of the image displayed on the LCD panel 421 in accordance with the control of the controller 210 and also adjusts an offset and/or the gain of the image signal inputted from a video processor (not shown) to vary the contrast. The panel driver 440 provides the image signal outputted from the image processor 240 to the LCD panel 421 so as to display image data scaled by the image processor 430. The panel driver 440 also on/off switches or outputs a driving signal corresponding to a gray scale of an image data to the LCD panel 421 so as to adjust the offset and/or the gain of the LCD panel 421.

As described above, the present invention always provides a constant square wave from the outside of the inverter. Embodiments of the present invention are not affected by the temperature within the inverter because a constantly oscillating square wave is generated in accordance with the control of the controller. The constantly oscillating square wave is used to supply a burst dimming signal with a consistent On/Off duty cycle to the backlight assembly. Thus, the consistent On/Off duty cycle of the burst dimming signal prevents the generation of wavy noise on the screen. Because embodiments of the present invention generates the burst dimming signal using the constantly oscillating square wave, the burst dimming signal can be controlled to accommodate changes to different scanning systems, such as from the PAL system to the NTSC system or from the NTSC system to the PAL system.

It will be apparent to those skilled in the art that various modifications and variations can be made in the driving apparatus of a backlight and method of driving a backlight using the same of the present invention without departing from the spirit or scope of the invention. Thus, it is intended that the present invention cover the modifications and variations of this invention provided they come within the scope of the appended claims and their equivalents.

What is claimed is:

1. A driving apparatus of a backlight, comprising:

a controller for controlling square wave oscillation;

a square wave oscillator for oscillating a constant square wave signal in accordance with a square wave oscillation control signal from the controller; and a signal generator for generating a burst dimming signal using the square wave signal, wherein the controller provides a square wave generation execution program for controlling generation of the constant signal, wherein the square wave generation execution is carried out in accordance with a user's command, if the square wave generation execution program is carried out, then the controller outputs the square wave oscillation control signal for generating the constant square wave signal to the square wave oscillator, wherein the signal generator includes an inverter, wherein the signal generator includes an integrator for converting the constant square wave signal from the square wave oscillator into a triangular wave signal and a comparator for comparing the triangular wave signal converted by the integrator with a direct current voltage to generate the burst dimming signal, wherein the direct current voltage has level of 0V to 3.3V from the controller, wherein the triangular wave signal is supplied to an inverting input terminal of the comparator and the direct current voltage is supplied to a non-inverting input terminal of the comparator, wherein the comparator generates a first signal with a low level when the triangular wave signal is greater than the direct current voltage and a second signal with a high level when the triangular wave signal is smaller than the direct current voltage, wherein the integrator includes a resistance connected between an output terminal of the square wave oscillator and an input terminal of the comparator, and a capacitor in which an electrode of the capacitor is commonly connected to the input terminal of the comparator and another electrode of the capacitor connected a ground, and wherein the square wave oscillator is configured to output a constant square wave signal regardless of the internal temperature of the inverter by being installed outside of the inverter.

2. The driving apparatus of the backlight as claimed in claim 1, wherein the inverter is positioned outside of the controller.

3. The driving apparatus of the backlight as claimed in claim 1, wherein the inverter is positioned outside of the square wave oscillator.

4. The driving apparatus of the backlight as claimed in claim 1, wherein the comparator outputs a burst dimming signal having a consistent On/Off duty cycle.

5. The driving apparatus of the backlight as claimed in claim 1, wherein the controller is positioned outside of the signal generator.

6. The driving apparatus of the backlight as claimed in claim 1, wherein the square wave oscillator is positioned outside of the signal generator.

7. A method of driving a backlight, comprising:

generating a square wave oscillation control signal for controlling a square wave oscillation by using a square wave generation execution program;

oscillating a constant square wave signal based upon with the square wave oscillation control signal by a square wave oscillator; and generating a burst dimming signal having a consistent On/Off duty cycle in an inverter based upon the constant square wave signal, wherein the square wave generation execution is carried out in accordance with a user's command, wherein the generating the burst dimming signal includes comparing the triangular wave signal with a direct current voltage and then generating the burst dimming signal having a consistent On/Off duty cycle by using a comparator, wherein the triangular wave signal is supplied to an inverting input terminal of the comparator and the direct current voltage is supplied to a non-inverting input terminal of the comparator, wherein the comparator generates a first signal with a low level when the triangular wave signal is greater than the direct current voltage and a second signal with a high level when the triangular wave signal is smaller than the direct current voltage, wherein the square wave oscillator is configured to output a constant square wave signal regardless of the internal temperature of the inverter by being installed outside of the inverter, and wherein if the square wave generation execution program is carried out, then the square wave oscillation control signal is supplied to a square wave oscillator for oscillating the constant square wave signal.

8. The method as claimed in claim 7, wherein the generating the burst dimming signal includes converting the oscillation square wave signal into a triangular wave signal.

9. The method as claimed in claim 7, wherein the square wave oscillation control signal is generated outside of the inverter.

10. The method as claimed in claim 7, wherein the constant square wave signal is generated outside of the inverter and inputted into the inverter.

11. An image display apparatus, comprising:

a controller for providing a square wave oscillation control signal to control a square wave oscillation;

a square wave oscillator for oscillating a constant square wave signal in accordance with the square wave oscillation control signal of the controller; and an inverter for generating a burst dimming signal using the constant square wave signal from the square wave oscillator, wherein the square wave oscillator is positioned outside of the inverter, wherein the controller provides a square wave generation execution program for controlling generation of the constant signal, wherein the square wave generation execution is carried out in accordance with a user's command, if the square wave generation execution program is carried out, then the controller outputs the square wave oscillation control signal for generating the constant square wave signal to the square wave oscillator, wherein the inverter includes an integrator for converting a constant square wave from the square wave oscillation into a triangular wave and a comparator for comparing the triangular wave converted by the integrator with a direct current voltage to generate a burst dimming, wherein the direct current voltage has level of 0V to 3.3V from the controller, wherein the triangular wave signal is supplied to an inverting input terminal of the comparator and the direct current voltage is supplied to a non-inverting input terminal of the comparator, wherein the comparator generates a first signal with a low level when the triangular wave signal is greater than the direct current voltage and a second signal with a high level when the triangular wave signal is smaller than the direct current voltage, wherein the integrator includes a resistance connected between an output terminal of the square wave oscillator and an input terminal of the comparator, and a capacitor in which an electrode of the capacitor is commonly connected to the input terminal of the comparator and another electrode of the capacitor connected a ground, and wherein the square wave oscillator is configured to output a constant square wave signal regardless of the internal temperature of the inverter by being installed outside of the inverter.

12. The image display apparatus as claimed in claim 11, wherein the burst dimming signal is outputted from the comparator and has a consistent On/Off duty cycle.

* * * * *